United States Patent [19]

Wershofen

[11] Patent Number: 4,803,012

[45] Date of Patent: Feb. 7, 1989

[54] ETHOXYLATED AMINES AS SOLUTION PROMOTERS

[75] Inventor: Thomas Wershofen, Monchen-Gladbach, Fed. Rep. of Germany

[73] Assignee: Henkel Kommanditgesellschaft auf Aktien, Duesseldorf, Fed. Rep. of Germany

[21] Appl. No.: 12,102

[22] Filed: Feb. 6, 1987

[30] Foreign Application Priority Data

Feb. 6, 1986 [DE] Fed. Rep. of Germany ..... 3603579

[51] Int. Cl.[4] ..... C11D 3/30; C11D 1/00

[52] U.S. Cl. ..... 252/544; 252/548; 252/525; 252/174.21

[58] Field of Search ..... 252/544, 525, 548, 174.21

[56] References Cited

U.S. PATENT DOCUMENTS

| | | | |
|---|---|---|---|
| 3,336,231 | 8/1967 | Marsh et al. | 252/152 |
| 3,456,012 | 7/1969 | Swenson | 564/504 |
| 3,456,013 | 7/1969 | Egan et al. | 564/505 |
| 3,706,676 | 12/1972 | Franke et al. | 252/544 |
| 3,962,151 | 6/1976 | Dekker et al. | 252/548 |
| 4,005,020 | 1/1977 | McCormick | 252/8.55 B |
| 4,124,517 | 11/1978 | Hisamoto et al. | 252/89 DC |
| 4,306,987 | 12/1981 | Kaneko | 252/99 |
| 4,435,317 | 3/1984 | Gerritsen et al. | 252/547 |
| 4,486,329 | 12/1984 | Ellis et al. | 252/117 |
| 4,507,219 | 3/1985 | Hughes | 252/118 |
| 4,597,898 | 7/1986 | Vander Meer | 252/529 |
| 4,683,008 | 7/1987 | Betts | 134/27 |
| 4,692,276 | 9/1987 | Schramm | 252/548 |
| 4,719,044 | 1/1988 | Piorr et al. | 252/548 |
| 4,744,923 | 5/1988 | Piorr et al. | 252/544 |

*Primary Examiner*—Paul Lieberman
*Assistant Examiner*—Ronald A. Krasnow
*Attorney, Agent, or Firm*—Ernest G. Szoke; Wayne C. Jaeschke

[57] ABSTRACT

The invention relates to the use of one or more ethoxylated fatty amines corresponding to the following general formula

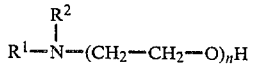

(I)

in which n is an integer of from 2 to 30, $R^1$ is a $C_{8-24}$ straight-chain or branched-chain, saturated or unsaturated alkyl, and $R^2$ has the formula

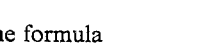

(II)

or the formula

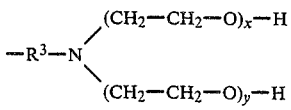

(III)

where $R^3$ is a $C_{2-6}$ alkylene, and m, x, and y are each an integer of from 0 to 30, as solution promoters in detergent concentrates for detergent solutions.

7 Claims, No Drawings

ETHOXYLATED AMINES AS SOLUTION PROMOTERS

BACKGROUND OF THE INVENTION

1. Field of the Invention

This invention relates to a method for using ethoxylated fatty amines as solution promoters or solubilizers in surfactant or detergent concentrates for detergent solutions, more especially in detergent concentrates for automatic bottle washing.

2. Statement of Related Art

In general, substances which are sparingly soluble or insoluble in water may be dissolved by adding solution promoters or solubilizers to the aqueous solutions. In many cases, the solution-promoting effect of additives such as these is based on the fact that the molecules of the substance added as solubilizer have a surfactant-like structure, i.e., a hydrophilic part and a hydrophobic part. In aqueous solutions, the solubilizer molecules form micelles in which the hydrophilic molecule ends are directed outwards to the water while the hydrophobic molecule ends are directed into the interior of the micelles. During solubilization, substances insoluble in the aqueous phase are incorporated in the interior of the micelles and are thus apparently dissolved in the aqueous phase. The quantity of solubilizer required to obtain a clear solution depends not only upon the quantity of substance to be dissolved, but also upon the solubilizing power of the solution promoter.

In the washing of beverage bottles, the various types of soil present in the bottle have to be removed to enable the bottle to be hygienically refilled. The keeping properties of the bottled beverage depend, inter alia, upon the complete removal of mechanical, biological or microbiological soil.

In addition, bottles are generally relabelled as part of the refilling process. Accordingly, not only external soil, but also labels and glue residues have to be completely removed to establish the proper conditions for labelling.

The washing of bottles intended for the beverage industry is often carried out using alkaline detergent solutions containing a plurality of components which (apart from relatively large quantities, for example 1 to 2%, of alkali metal hydroxides, more especially sodium hydroxide) contain other components, of which the quality and quantity are coordinated with the particular washing problem. At the present time, the detergent solutions are prepared in the corresponding bottle washing plants by addition of a detergent concentrate which contains all the necessary additives for problem-free washing to the plant water, and by subsequent addition of sodium hydroxide. However, in addition to readily water-soluble additives, such as inorganic salts and also inorganic and organic acids, most detergent concentrates also contain components sparingly soluble in water which, in the event of prolonged storage under adverse storage conditions, separate from the liquid detergent concentrates, thereby preventing the detergent from developing its full effectiveness in the in-use solutions. Components such as these are in particular the wetting agents and foam inhibitors present in the detergent concentrates, whose absence from the detergent solution results in defective operation of the washing plant and hence in unacceptable stoppages. Stoppages such as these frequently are caused by overfoaming of the bottle washing plant or even by labels which have not been removed. In order to keep these sparingly water-soluble detergent constituents in solutions, it has previously been standard practice to add to the detergent concentrates relatively large quantities of sodium cumene sulfonate which acts as a solution promoter and keeps even poorly soluble detergent components in solution. Although sodium cumene sulfonate enables the detergent concentrates to be stabilized, the use of this compound as a solution promoter has distinct disadvantages. On the one hand, the cost of detergent concentrates containing sodium cumene sulfonate is considerably increased by the high price of the solution promoter used in large quantities (in some cases detergent concentrates contain up to 25% of this compound), so that on economic grounds alone there is a need for a less expensive compound capable of acting as solution promoter. In addition, it is known that, particularly in the washing of beverage bottles, sodium cumene sulfonate as a detergent ingredient does not increase or assist the cleaning power of the prior art solutions. Accordingly, its sole function is to keep other poorly soluble components present in the detergent concentrates stably dissolved in the aqueous solution.

In addition, lower, generally branched alcohols, for example isopropanol, are known as solution promoters from the prior art. However, the disadvantage of isopropanol is that its handling involves special safety measures because isopropanol is not only readily inflammable, it also has a low flash point. In addition, its effect as a solution promoter is distinctly poorer than that of sodium cumene sulfonate.

DESCRIPTION OF THE INVENTION

Other than in the operating examples, or where otherwise indicated, all numbers expressing quantities of ingredients or reaction conditions used herein are to be understood as modified in all instances by the term "about ".

The present invention provides a method for using new solution promoters or solubilizers by which even poorly soluble components of the detergent concentrate may be brought stably into solution and which therefore guarantee unlimited stability in storage of detergent concentrates comprising components containing strongly hydrophobic groups. Since the stability of solutions such as these is also jeopardized at relatively high temperatures such as occasionally occur in stock rooms, the detergent concentrate has to be stabilized for an indefinite period both for temperatures below freezing point and also for temperatures of up to 50° C. In addition, the solution promoters provided by the invention are inexpensive and, in addition to stabilizing the detergent concentrates, also perform other functions in the washing process. These additional functions include primarily an acceleration of the removal of bottle labels, fast and better removal of soiling residues, and better emulsification of the soil residues removed in the detergent solution after use.

Accordingly, the present invention relates to a method for using one or more ethoxylated fatty amines corresponding to the following general formula $$R^1-\overset{\overset{\displaystyle R^2}{|}}{N}-(CH_2-CH_2-O)_nH \qquad (I)$$

in which n is an integer of from 2 to 30, $R^1$ is a $C_{8-24}$, preferably $C_{12-18}$, straight-chain or branched-chain, saturated or unsaturated alkyl, $R^2$ has the formula $$-(CH_2-CH_2-O)_m-H \quad (II)$$

or the formula $$-R^3-N\begin{matrix}(CH_2-CH_2-O)_x-H \\ (CH_2-CH_2-O)_y-H\end{matrix} \quad (III)$$

where $R^3$ is a $C_{2-6}$ alkylene, and m, x and y are each an integer of from 0 to 30, as solution promoters in detergent concentrates for detergent solutions, more especially in detergent concentrates for washing bottles.

Fatty amines corresponding to formula II may be prepared from natural sources by methods known per se. They may be used either individually or in naturally occurring mixtures containing alkyl radicals of different chain lengths, for the ethoxylation reaction.

The ethoxylation reaction is also known per se and is preferably carried out in known manner on fatty amines obtainable from natural sources. Mixtures containing a different number (n+m) of ethoxy radicals are also formed during the ethoxylation reaction. According to the invention, preferred compounds are those in which the average degree of ethoxylation (n+m) is 2 to 15. Ethoxylated fatty amines having an average degree of ethoxylation (n+m) of 10 to 15 are particularly preferred.

According to the invention, ethoxylated diamines corresponding to formula III may also be used in active-substance concentrates for detergents. In the present context, "alkylene" is understood to mean alkyl radicals containing free valencies at each of the terminal carbon atoms (also called "polymethylene").

Diamines such as these have a degree of ethoxylation of preferably 2 to 15 and more preferably of 10 to 15, the total number of ethoxy groups being meant in this case. This means that, in general formula (I), the sum (n+x+y) is in the above-mentioned range of 2 to 15 and preferably of 10 to 15.

As mentioned above, preferred fatty amines are obtainable from natural sources, for example from natural fats and oils, and may be used for the ethoxylation either directly from the natural sources or after further chemical processing, for example hydrogenation of unsaturated side chains. Fatty amines such as these are, in particular, cocosamine, tallow fatty amine, oleylamine, octadecylamine, tallow fatty oleylamine, stearylamine and, in the case of diamines, tallow fatty propylenediamine. The average degree of ethoxylation is preferably 2 to 15 and is largely determined by the consistency and solubility in water of the ethoxylated fatty amines so obtained. Thus, pasty or even solid products are less preferred because of their poorer incorporability in liquid concentrates and fatty amines having relatively high degrees of ethoxylation are also less preferred because of their poorer solubility in water. However, the tendency of the fatty amine ethoxylates towards (undesireable) foaming decreases with an increasing degree of ethoxylation.

The quantity in which the ethoxylated fatty amines of general formula (I) are used in accordance with the invention is 1 to 15% by weight of one or more fatty amines, based on the total weight of the detergent concentrate. Even where several fatty amines are used together, the total amount should not exceed the concentration value of 15%.

The advantage of using at least one ethoxylated fatty amine corresponding to general formula (I) in accordance with the invention over known compounds used for the same purpose lies in the fact that the ethoxylated fatty amines mentioned may be favorably obtained from abundant starting materials by simple process steps which may be carried out conveniently and with high yields on an industrial scale. In addition, their favorable effect in aqueous detergent concentrates is not confined to their solution-promoting function. On the contrary, it has also been found that, where the ethoxylated fatty amines of general formula (I) are used in accordance with the invention, the labels glued on beverage bottles are removed more quickly. In addition, residues in the bottles, more especially large mold patches or other soiling residues, may be removed more quickly and completely, enabling the invention compounds to be used in industrial bottle washing plants. The low tendency of the invention compounds towards foaming is another advantage in this regard.

Another advantage of using the ethoxylated fatty amines corresponding to general formula (I) (which if desired may also be used together with other compounds known as solubilizers, such as isopropanol), is that even aluminum labels fastened on the necks of certain beverage bottles can be removed more easily and, in addition, colored pigments which become detached from the surface of the labels removed are emulsified in the detergent solution and do not float on its surface.

The solution-promoting effect of the invention's ethoxylated fatty amines is demonstrated by the fact that the detergent concentrates containing a number of detergent components remain stable for indefinite periods both at high temperatures (50° C.) and at low temperatures (−18° C.). Another notable effect of using the ethoxylated fatty amine solution promoters in accordance with the invention is that even after freezing and defrosting of the detergent concentrates a clear product is obtained in which even the organic components, such as wetting agents and foam inhibitors, remain clearly dissolved.

The detergent concentrates are otherwise conventional and contain other components in addition to the ethoxylated fatty amines and are prepared by methods known per se, the individual components being mixed together in any order. However, an aqueous solution of the inventive ethoxylated fatty amine solubilizers is advantageously introduced first and the other detergent components added afterwards. The pH of the detergent concentrates is adjusted to from 1 to 7.

Where used in the industrial washing of beverage bottles, the aqueous detergent compositions which are made up as concentrates are added to the process water of the bottle washing machine in concentrations determined by the degree of soiling of the bottles to be washed, by the hardness of the water and possibly by other parameters. In general, the concentration of detergent in the washing solutions is from 0.1 to 0.5% by weight. However, higher concentrations are also possible, particularly when the hardness of the process water or the high degree of soiling of the bottles necessitates a higher concentration of one of the detergent components. Detergent concentrations below 0.1% by weight or above 0.5% by weight, based on the total cleaning solution, are also possible for other applications.

Alkali metal hydroxides, preferably sodium hydroxide, are then generally added separately to the process or detergent solutions. In automatic bottle washing, the concentrations of sodium hydroxide in the washing solutions are normally in the range of from 1 to 3% of the total solution.

In principle, however, it is also possible directly to add the quantities of sodium hydroxide required for washing to the detergent concentrates containing the ethoxylated fatty amines according to the invention.

The invention is further illustrated by the following Examples.

1. Preparation of the detergent concentrate

Detergent concentrates having the composition indicated in Examples 1 to 4 and in the comparison Examples were prepared by methods known per se. To this end, the water and the ethoxylated fatty amine acting as solution promoter or the corresponding comparison compound were initially introduced and the remaining detergent components successively added thereafter.

In the formulation examples, EO stands for ethylene oxide and PO for propylene oxide.

2. Assessment of the stability of the detergent concentrate

The detergent concentrates prepared in accordance with (1) were visually assessed (a) immediately after preparation, (b) several times a week over a storage period of more than 1 year at 5° C. and 50° C. and (c) after freezing and defrosting.

In every case, the detergent concentrates were clear. It was not possible to observe any formation of different phases, thus indicating that the solutions useful in the inventive methods are extremely stable.

3. Label removal

Extensive label removal tests were carried out with beverage bottles on a laboratory scale. The period of time for which the bottles must be in contact with the detergent solution to obtain complete removal of all the labels adhering to the bottles was measured. The removal times for the particular tests in minutes and seconds are shown in Example 1, Table 1 and Example 5, Table 3.

In this connection, the corresponding detergent solutions were also tested for their ability to discharge the labels from the detergent solution satisfactorily.

In this test, the labels must not disintegrate into fibers during the test period, i.e., before they have been completely removed from the bottle surface, and must not show any sign of adhering, i.e., adsorbed, surfactants after removal from the detergent solution.

4. Washing of heavily soiled bottles

Washing tests were carried out on a laboratory scale at 75° C. on bottles containing dried-on, firmly adhering fruit flesh residues (tomato flesh) and on bottles coated with mold. In this case, too, detergent concentrates containing the ethoxylated fatty amines according to the invention proved to be superior to the state-of-the-art products.

5. Removal of aluminum bottle neck labels

Laboratory tests were carried out on bottles containing aluminum labels on the bottle neck beneath the opening. The removal times are shown in Example 1, Table 2.

6. Saving of energy

Washing processes for beverage bottles frequently require high temperatures of the wash liquor when the bottles are heavily soiled or carry firmly adhering labels on their outer surface. This gives rise to high energy expenditures for generating steam and for heating the wash liquor. In addition, in view of the high alkalinity of the wash liquor, large quantities of fresh water are required to rinse the bottles free from alkali after washing. At the same time, the previously heated bottles are also cooled down again to a lower temperature. High temperatures of the wash liquor also necessitate relatively high intermediate spraying and warm water temperatures which in turn results in more scale in these zones of the washing plant. Accordingly, improved removal through constituents present in the detergent solutions means that energy is saved for producing hot water or steam and less fresh water is required for the bottle washing process. The label removal times at different process temperatures are also shown for the individual detergent formulations (cf. Example 1, Table 1 and Example 5, Table 3).

7. Foaming behavior

Foaming behavior was assessed in accordance with Germany industrial Norm (DIN) Draft 53,902. To this end, the wash liquors containing a fatty amine ethoxylate were tested in a foam beating apparatus (DIN 53,902, Part 1). Increasing quantities of a test foamer ("P3 Optenit", a product of Henkel KGaA) were added to the liquors and the foam volumes measured after 5×100 beats. The values obtained are shown in Table 4, Example 6.

The smaller the foam volumes, the better the foam-inhibiting effect of the detergent concentrate. Foam interferes very seriously with the bottle washing process.

EXAMPLE 1

A detergent concentrate for use in accordance with the invention was prepared by mixing the following components together (all percentages in % by weight):

| | |
|---|---|
| 31.75% | water of condensaton, |
| 0.25% | potassium iodide, |
| 10.00% | phosphoric acid (75%), |
| 10.00% | gluconic acid (50%), |
| 6.00% | amino-tris(methylenephosphonic acid) (50%), |
| 2.00% | 1-hydroxyethane-1,1-diphosphonic acid (60%), |
| 3.00% | 2-phosphonobutane-1,2,4-tricarboxylic acid (50%), |
| 2.00% | adduct of nonylphenol with 9.5 mols EO, |
| 13.00% | adduct of ethylenediamine with 30 mols EO and 60 mols PO, |
| 11.00% | adduct of propylene glycol with 4.5 mols EO and 29.8 mols PO, and |
| 11.00% | adduct of cocosamine with 12 mols EO. (INVENTIVE SOLUTION PROMOTER) |
| 100.00% | |

Assessment of stability

This detergent concentrate remained clear and, hence, stable over the entire test temperature range; no phase separation was observed. The product obtained in the absence of the adduct of cocosamine with 12 mols EO was neither clear nor stable.

Label removal

Label removal tests were carried out on various beverage bottles all of which were provided with "Chromalux" (a trademark of Fa. Zanders Feinpapiere AG) labels. To this end, detergent solutions containing 1.5% by weight NaOH and 0.2% by weight active detergent concentrate were applied to the various bottles.

The removal times are shown in Table 1 below for the various test conditions and types of bottles. Detergent solutions containing 1.5% by weight NaOH and 0.2% by weight active detergent concentrate having the composition shown in Comparison Examples 1 and 2 below (using sodium cumene sulfonate and isopropanol as solution promoter) were used for comparison.

TABLE 1

| | Removal times in the label removal test | | | | |
|---|---|---|---|---|---|
| | | | Removal times (secs.) using the solution of | | |
| Bottles[1] | Temp. (°C.) | Water hardness (°G. h) | Ex. 1 | Comp. Ex. 1 | Comp. Ex. 2 |
| A | 65 | 18 | 260 | 277 | 511 |
| B | 65 | 18 | 232 | — | 491 |
| C | 70 | 18 | 202 | 283 | — |
| D | 70 | 18 | 245 | — | 365 |
| E | 70 | 18 | 125 | — | 410 |
| D | 70 | 18 | 290 | 328 | 453 |
| F | 70 | 18 | 283 | 425 | 650 |
| C | 70 | 18 | 333 | 383 | 431 |

Remarks:
[1]Bottle material:
A: 1-liter bottle apple juice, "Fanta", "Cappy", "Sprite"
B: 1-liter bottle "Lift-Zitrone", "Sprite", "Fanta"
C: 1-liter bottle "Sprite"
D: 1-liter bottle "Coca-Cola"
E: 1-liter bottle "Coca-Cola" light
F: 0.5-liter bottle "Coca-Cola"
"Fanta", "Cappy", "Sprite", "Lift", "Coca-Cola" are trademarks of the Coca-Cola Bottling Corp.

Result:

As can be seen from the values in Table 1, labels can be removed considerably better and faster with the detergent solutions used in accordance with the invention than with state-of-the-art detergent solutions under comparable conditions.

COMPARISON EXAMPLE 1

A detergent concentrate was prepared as in Example 1 by mixing the following components together (all quantities in % by weight):

| | |
|---|---|
| 29.25% | water of condensation, |
| 0.25% | potassium iodide, |
| 10.00% | phosphoric acid (75%), |
| 10.00% | gluconic acid (50%), |
| 6.00% | amino-tris-(methylenephosphonic acid) (50%), |
| 2.00% | 1-hydroxyethane-1,1-diphosphonic acid (60%), |
| 3.00% | 2-phosphonobutane-1,2,4-tricarboxylic acid (50%), |
| 2.00% | adduct of nonylphenol with 9.5 mols EO, |
| 5.00% | adduct of ethylenediamine with 30 mols EO and 60 mols PO, |
| 0.50% | adduct of cetyl/oleyl fatty alcohol ("Ocenol", a trademark of Henkel KCaA) with 2 mols of EO, |

-continued

| | |
|---|---|
| 8.00% | adduct of ethylenediamine with 8 mols EO and 52 mols PO, and |
| 24.00% | sodium cumene sulfonate (40%). (PRIOR ART SOLUTION PROMOTER) |
| 100.00% | |

A detergent solution was prepared from this concentrate in the same way as described in Example 1, containing 0.2% of the concentrate and, in addition, 1.5% by weight of NaOH. The removal times in the label removal test are shown in Table 1 above.

COMPARISON EXAMPLE 2

A detergent concentrate was prepared from the following components in the same way as described in Example 1, being added in a quantity of 0.2% to a detergent solution for an automatic bottle washing plant containing 1.5% by weight NaOH.

| | |
|---|---|
| 11.25% | water of condensation, |
| 0.25% | potassium iodide, |
| 40.00% | phosphoric acid, 75%, |
| 12.00% | amino-tris-(methylenephosphonic acid), 50%, |
| 5.00% | 2-phosphonobutane-1,2,4-tricarboxylic acid, 50% |
| 5.00% | 1-hydroxyethane-1,1-diphosphonic acid, 60% |
| 6.50% | isopropanol, 80% (PRIOR ART SOLUTION PROMOTER), |
| 19.00% | $C_{12-18}$ fatty alcohol ("Lorol", a trademark of Henkel KCaA)-9.1 mols EO-butylether, and |
| 1.00% | adduct of cetyl/oleyl fatty alcohol ("Ocenol", a trademark of Henkel KCaA) with 2 mols EO. |
| 100.00% | |

The removal times in the label removal test obtained with a detergent solution containing this concentrate are also shown in Table 1 above.

Removal of bottle neck labels of aluminum foil

Detergent solutions were prepared using the detergent concentrates of Example 1 and Comparison Examples 1 and 2 (0.2% detergent concentrate and 1.5% sodium hydroxide in each solution) and the time taken by aluminum-foil labels to separate from bottle necks was determined (test conditions: water 0° G.h temperature 75° C.).

TABLE 2

| | Separation time in minutes | | |
|---|---|---|---|
| Test | Detergent solution containing concentrate of | | |
| No. | Ex. 1 | Comp. Ex. 1 | Comp. Ex. 2 |
| 1 | 4.93 | 6.15 | 6.38 |
| 2 | 6.27 | 7.08 | 7.52 |

The comparison shows that, in this case, too, the use of the fatty amines according to the invention in the detergent concentrate led to shorter separation times and therefore to a better result.

EXAMPLES 2 TO 4

Detergent concentrates were prepared as in Example 1 by mixing the following components together:

| | 2. |
|---|---|
| 50.75% | water of condensation, |

-continued

| | |
|---|---|
| 0.25% | potassium iodide, |
| 25.00% | phosphoric acid (75%), |
| 2.00% | 1-hydroxyethane-1,1-diphosphonic acid (60%), |
| 1.00% | amino-(trimethylenephosphonic acid) (50%), |
| 1.00% | 2-phosphonobutane-1,2,4-tricarboxylic acid (50%), |
| 16.00% | $C_{12-18}$ fatty alcohol ("Lorol", a trademark of Henkel KCaA)-9.1 mols EO-butylether, |
| 1.00% | adduct of fatty alcohol with 2 mols EO, and |
| 3.00% | adduct of cocosamine with 12 mols EO (INVENTIVE SOLUTION PROMOTER) |
| 100.00% | |

3.

| | |
|---|---|
| 38% | water of condensation, |
| 22% | 2-phosphonobutane-1,2,4-dicarboxylic acid (50%), |
| 22% | $C_{12-18}$ fatty alcohol ("Lorol", a trademark of Henkel KCaA)-9.1 mols EO-butylether, |
| 15% | isopropanol (80%) (PROIR ART SOLUTION PROMOTER), and |
| 3% | adduct of cocosamine with 12 mols EO (INVENTIVE SOLUTION PROMOTER) |
| 100% | |

This detergent concentrate is a phosphate-free concentrate.

4.

| | |
|---|---|
| 31.75% | water of condensation, |
| 0.25% | potassium iodide, |
| 10.00% | phosphoric acid (75%), |
| 10.00% | gluconic acid (50%), |
| 6.00% | amino-tris-(methylenephosphonic acid) (50%), |
| 2.00% | 1-hydroxyethane-1,1-diphosphonic acid, |
| 3.00% | 2-phosphonobutane-1,2,4-tricarboxylic acid (50%), |
| 2.00% | adduct of nonylphenol with 9.5 mols EO, |
| 13.00% | adduct of ethylenediamine with 30 mols EO and 60 mols PO, |
| 11.00% | adduct of 1,2-propylene glycol with 4.5 mols EO and 29.8 mols PO, and |
| 11.00% | adduct of cocosamine with 12 mols EO (INVENTIVE SOLUTION PROMOTER) |
| 100.00% | |

Immediately after their preparation, the detergent concentrates were clear and did not show any separation of individual components. Even after prolonged storage (3 months to 1 year) at 5° C. and at 50° C., the solutions remained clear and did not show any change in appearance after freezing and defrosting.

EXAMPLE 5

Inventive Compositions

Detergent concentrates having the following composition were prepared using the individual fatty amine ethoxylates of Table 3:

| | |
|---|---|
| 10.0% | phosphoric acid (75%), |
| 10.0% | gluconic acid (50%), |

-continued

| | |
|---|---|
| 6.0% | amino-tris-(methylenephosphonic acid) (50%), |
| 2.0% | 1-hydroxyethane-1,1-diphosphonic acid (60%), |
| 3.0% | 2-phosphonobutane-1,2,4-tricarboxylic acid (50%), |
| 2.0% | adduct of nonylphenol with 9.5 mols EO, |
| 13.0% | adduct of ethylenediamine with 30 mols EO and 60 mols PO, |
| 0.5% | potassium iodide, |
| 11.0% | adduct of propylene glycol with 4.5 mols EO and 29.8 mols PO, |
| 31.5% | water, and |
| 11.0% | fatty amine ethoxylate according to Table 3 (INVENTIVE SOLUTION PROMOTER) |
| 100.0% | |

The label removal tests were carried out with hand-labelled bottles.

Label type: "Sprite" (a product of Coca-Cola Bottl. Corp.) "Chromalux" (a product of Zanders Feinpapiere AG)

Label glue: "Optal" 350 (a product of Henkel KGaA)

The test procedure and the apparatus used are as described in the Article "Zur Frage der Etikettenablosung von Getrankeflaschen, Teil II (On the Question of Label Removal from Beverage Bottles, Part II)", Brauweit 120 (1980), no. 41, pages 1492 to 1499. Liquor composition:

1.5%: NaOH, 0.2%: detergent concentrate, balance: Water 0° G.h, 70° C.

The removal times are shown in Table 3 below.

TABLE 3

| Average removal times (mins.) Inventive Solution Promoter | Time |
|---|---|
| Adduct of cocosamine with 2 mols EO | 5.40 |
| Adduct of cocosamine with 5 mols EO | 5.47 |
| Adduct of cocosamine with 12 mols EO | 4.70 |
| Adduct of cocosamine with 15 mols EO | 3.71 |
| Adduct of tallow fatty amine with 2 mols EO | 4.92 |
| Adduct of tallow fatty amine with 15 mols EO | 4.17 |
| Adduct of oleylamine with 5 mols EO | 5.52 |
| Adduct of oleylamine with 15 mols EO | 4.31 |
| Adduct of octadecylamine with 5 mols EO | 5.27 |

EXAMPLE 6

Foaming behavior

Detergent solutions containing ethoxylated fatty amines in different concentrations were tested for their foaming behavior in the same way as described above. The test foaming agent used was "P3 Optenit" (a trademark of Henkel KGaA). The composition of the liquor was as follows:

1.5%: NaOH, 0.2%: detergent concentrate containing the particular ethoxylated fatty amine, balance: water (0° G.h), Test temperature: 65° C.

The results are shown in Table 4 below.

TABLE 4

| Addition of test foaming agent (ppm) | Testing of foaming behavior Foam volumes (ml) Cocosamine +2 EO | Cocosamine +5 EO | Cocosamine +12 EO | Cocosamine +15 EO | Tallow fatty amine +2 EO | Tallow fatty amine +15 EO | Oleylamine +5 EO | Oleylamine +15 EO | Octadecylamine +15 EO | Tallow fatty propylenediamine +10 EO | Tallow fatty propylenediamine +15 EO |
|---|---|---|---|---|---|---|---|---|---|---|---|
| 0 | 10 | 10 | 5–10 | 5–10 | 5 | 5–10 | 5–10 | 5–10 | 5 | 5–10 | 0 |
| 100 | 20 | 20 | 15 | 20 | 5–10 | 15 | 5 | 10 | 5 | 10 | 5–10 |
| 200 | 20 | 20 | 20 | 20 | 5–10 | 20 | 5–10 | 15 | 5–10 | 15 | 10 |

TABLE 4-continued

| Addition of test foaming agent (ppm) | Testing of foaming behavior Foam volumes (ml) | | | | | | | | | | |
|---|---|---|---|---|---|---|---|---|---|---|---|
| | Cocosamine | | | | Tallow fatty amine | | Oleylamine | | Octadecyl-amine | Tallow fatty propylenediamine | |
| | +2 EO | +5 EO | +12 EO | +15 EO | +2 EO | +15 EO | +5 EO | +15 EO | +15 EO | +10 EO | +15 EO |
| 300 | 20 | 20 | 20 | 20 | 15 | 20 | 5-10 | 20 | 5-10 | 15 | 15 |
| 400 | 20 | 20 | 30 | 30 | 15 | 25 | 15 | 15 | 15 | 20 | 25 |
| 600 | 20 | 20 | 30 | 30 | 15 | 25 | 20 | 25 | 25 | 30 | 30 |
| 800 | 25 | 20 | 35 | 35 | 20 | 30 | 20 | 30 | 25 | 30 | 30 |
| 1000 | 30 | 25 | 40 | 40 | 20 | 30 | 20 | 30 | 30 | 40 | 40 |
| 1200 | 25 | 20 | 40 | 40 | 20 | 30 | 20 | 40 | 30 | 40 | 40 |
| 1400 | 25 | 25 | 40 | 50 | 25 | 40 | 20 | 40 | 30 | 40 | 40 |
| 1600 | 25 | 30 | 50 | 50 | 30 | 40 | 20 | 40 | 30 | 40 | 40 |
| 1800 | 25 | 30 | 50 | 50 | 30 | 50 | 30 | 40 | 35 | 40 | 40 |
| 2000 | 25 | 50 | 50 | 60 | 50 | 50 | 90 | 50 | 60 | 50 | 50 |
| 2200 | 25 | 140 | 60 | 70 | 140 | 50 | 220 | 50 | 220 | 50 | 50 |
| 2400 | 40 | 290 | 90 | 100 | 290 | 70 | >300 | 60 | >300 | 60 | 60 |
| 2600 | 100 | >300 | 100 | 100 | >300 | 80 | | 70 | | 90 | 70 |
| 3000 | >300 | | >300 | 280 | | 190 | | 170 | | 150 | 130 |
| 3200 | | | | >300 | | >300 | | >300 | | >300 | 280 |
| 3400 | | | | | | | | | | | >300 |

We claim:

1. A method for promoting the water solubility of detergent components in an aqueous concentrate wherein said detergent concentrate is formulated for the machine washing of bottles, comprising incorporating in said concentrate a solubility-promoting-effective amount of one or more ethoxylated fatty amines corresponding to the following general formula $$R^1-\overset{\overset{\displaystyle R^2}{|}}{N}-(CH_2-CH_2-O)_nH \qquad (I)$$

in which n is an integer of from 2 to 30, $R^1$ is a $C_{8-24}$ straight-chain or branched-chain, saturated or unsaturated alkyl, and $R^2$ has the formula $$-R^3-N\begin{matrix}(CH_2-CH_2-O)_x-H\\(CH_2-CH_2-O)_y-H\end{matrix} \qquad (III)$$

where $R^3$ is a $C_{2-6}$ alkylene, and x, and y are each an integer of from 0 to 30.

2. The method of claim 1 wherein $R^2$ is formula III and at least one of x or y is an integer of at least one.

3. The method of claim 2 wherein the sum of n+x+y is an integer from 2 to 15.

4. The method of claim 2 wherein the sum of n+x+y is an integer from 10 to 15.

5. The method of claim 1 wherein said one or more ethoxylated fatty amine is at least one adduct of cocosamine, tallow fatty amine, oleylamine, octadecylamine, tallow fatty oleylamine, stearylamine, or tallow fatty propylenediamine, with 2 to 15 mols of ethylene oxide.

6. The method of claim 1 wherein said one or more ethoxylated fatty amine is incorporated in said concentrate in a quantity of about 1 to 15% by weight, based upon the weight of said concentrate.

7. The method of claim 1 wherein $R^1$ is a straight-chain alkyl.

* * * * *